US008983087B2

(12) United States Patent
You et al.

(10) Patent No.: US 8,983,087 B2
(45) Date of Patent: Mar. 17, 2015

(54) AUDIO PLAYING DEVICE HAVING EARPHONE JACK WITH ROTATION DETECTOR

(75) Inventors: Qiang You, Shenzhen (CN); Jun Zhang, Shenzhen (CN); Jun-Wei Zhang, Shenzhen (CN); Tsung-Jen Chuang, New Taipei (TW)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 260 days.

(21) Appl. No.: 13/485,796

(22) Filed: May 31, 2012

(65) Prior Publication Data

US 2013/0148819 A1 Jun. 13, 2013

(30) Foreign Application Priority Data

Dec. 13, 2011 (CN) ..... 2011 1 0414444

(51) Int. Cl.
*H04R 1/10* (2006.01)
*H04R 3/00* (2006.01)

(52) U.S. Cl.
CPC ..... *H04R 3/00* (2013.01); *H04R 1/1041* (2013.01); *H04R 2430/01* (2013.01)
USPC ..... 381/74; 381/109; 381/58; 439/620.21

(58) Field of Classification Search
CPC ..... H04R 5/033; H04R 1/1041; H01R 13/66; H01R 24/58; H03G 3/001; H03G 3/20
USPC ..... 381/58, 59, 74, 104–109, 370; 439/620.21, 620.23, 825, 668, 669
See application file for complete search history.

(56) References Cited

U.S. PATENT DOCUMENTS

| | | | | |
|---|---|---|---|---|
| 4,593,162 | A * | 6/1986 | Rochette | 200/51.09 |
| 7,618,294 | B1 * | 11/2009 | Lin et al. | 439/669 |
| 7,635,265 | B2 * | 12/2009 | Hansson et al. | 439/20 |
| 7,800,360 | B2 * | 9/2010 | Johansson et al. | 324/207.25 |
| 8,192,234 | B2 * | 6/2012 | Wittenberg et al. | 439/620.21 |
| 8,320,587 | B2 * | 11/2012 | Dai et al. | 381/107 |
| 8,509,458 | B2 * | 8/2013 | Nakamura et al. | 381/107 |
| 2008/0247592 | A1 * | 10/2008 | Kourzanov | 381/384 |
| 2009/0107827 | A1 * | 4/2009 | Hansson et al. | 200/571 |

* cited by examiner

*Primary Examiner* — Vivian Chin
*Assistant Examiner* — Jason R Kurr
(74) *Attorney, Agent, or Firm* — Novak Druce Connolly Bove + Quigg LLP

(57) ABSTRACT

An audio playing device may operate in a first mode or a second mode. The audio playing device includes a speaker, an earphone jack receiving an earphone plug of an earphone, a sound output driver, a rotation angle detector, and a processor. The sound output driver only drives the speaker when the audio playing device operates in the first mode and only drives the earphone when the audio playing device operates in the second mode. The rotation angle detector generates a first mode change signal when the earphone plug is rotated in the earphone jack along a first direction over a predetermined angle. The processor changes operation of the audio playing device between the first mode and the second mode when the processor receives the first mode change signal from the rotation angle detector.

14 Claims, 3 Drawing Sheets

AUDIO PLAYING DEVICE HAVING EARPHONE JACK WITH ROTATION DETECTOR

BACKGROUND

1. Technical Field

The present disclosure relates to an audio playing device which has an earphone jack with rotation detector.

2. Description of Related Art

Audio playing devices include a speaker and a headphone jack for inserting an earphone plug. Each time the audio playing device changes operation from an earphone playing mode into a speaker playing mode, a user needs to pull out the earphone plug from the headphone jack and readjust output sound volume of the audio playing device, therefore, an operation of the audio playing device is relatively inconvenient.

Therefore, a new audio playing device is desired to overcome the above-described shortcomings.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Reference will now be made to the drawings to describe various inventive embodiments of the present disclosure in detail, wherein like numerals refer to like units throughout.

Figure 1:
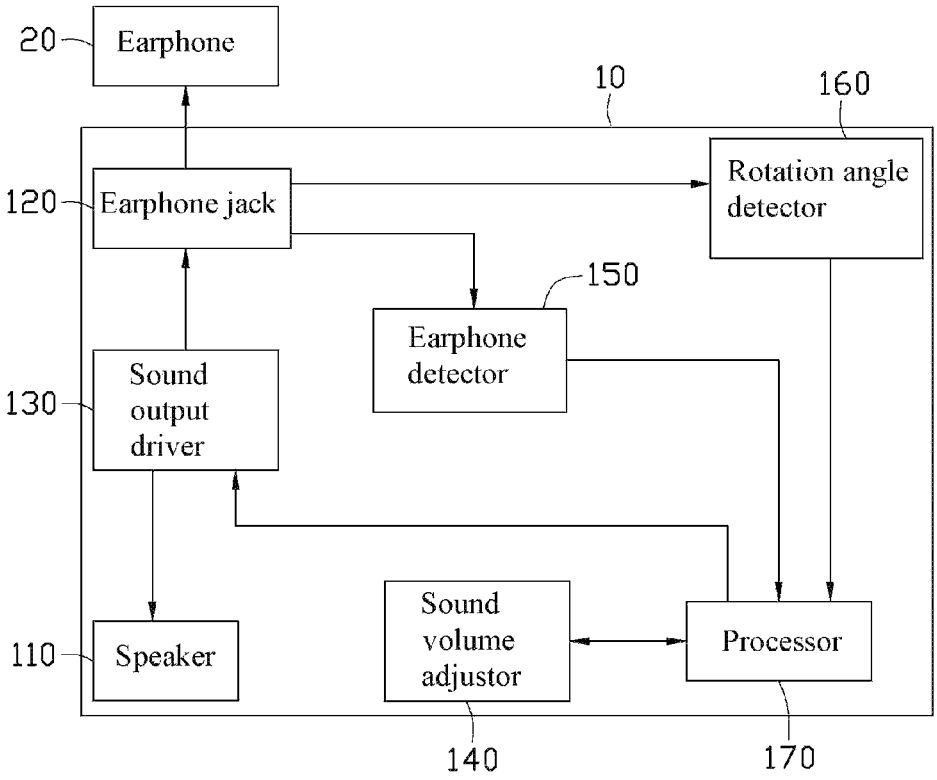
FIG. 1 is a schematic, block diagram of an audio playing device according to one embodiment of the present disclosure.

Referring to FIG. 1, a block diagram of an audio playing device 10 according to one embodiment of the present disclosure is shown. The audio playing device 10 includes a speaker 110, an earphone jack 120, a sound output driver 130, a sound volume adjustor 140, an earphone detector 150, a rotation angle detector 160, and a processor 170.

The earphone jack 120 is configured to receive an earphone plug (not shown) of an earphone 20.

The speaker 110 or the earphone 20 is driven by the sound output driver 130 to output sounds for a user.

The sound volume adjustor 140 is configured to adjust a sound volume of the outputted sound from the earphone 20 or the speaker 110. In one embodiment, the sound volume adjustor 140 may include a sound volume increasing button and a sound volume decreasing button for increasing and decreasing the sound, respectively. In an alternative embodiment, the sound volume adjustor 140 may further store a current sound volume, a maximum sound volume, and a maximum sound volume output from the speaker 110 or the earphone 20.

The earphone detector 150 is configured to detect if the earphone plug is inserted into the earphone jack 120, and generate an initial mode change signal to the processor 170 when the earphone plug is inserted into the earphone jack 120.

Figure 2:
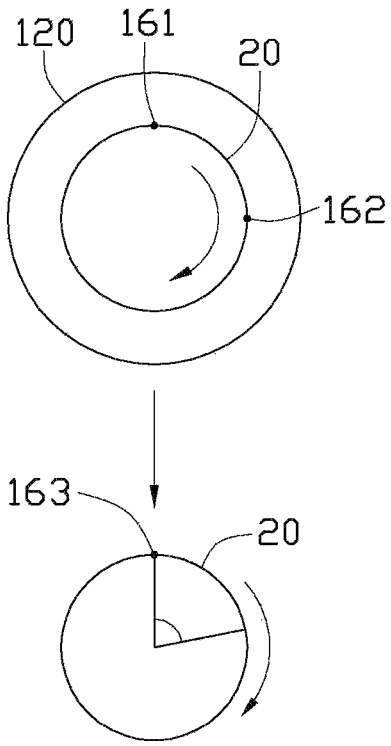
FIGS. 2-3 are schematic diagrams showing a method for changing operation mode of the audio playing device of FIG. 1.
Figure 3:
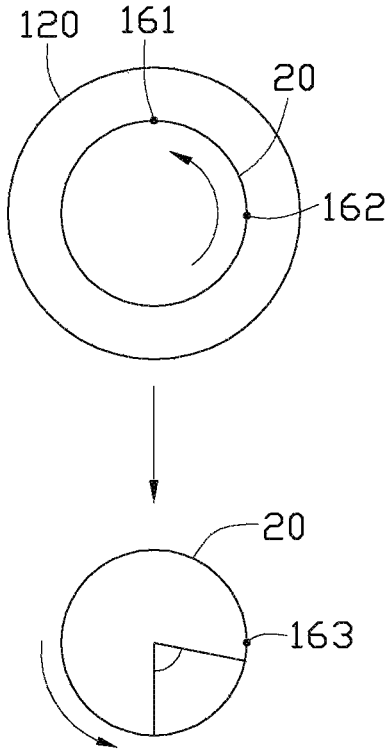

As shown in FIGS. 2 and 3, the rotation angle detector 160 is configured to detect a rotation angle of the earphone plug which is received in the earphone jack 120. In one embodiment, the rotation angle detector 160 includes two first contacting pads 161, 162 arranged along the internal surface of the earphone jack 120 and a second contacting pad 163 arranged on the earphone plug corresponding to the first contacting pads 161, 162. When the earphone plug is rotated in the earphone jack 120 along a first direction as shown in FIG. 2, the second contacting pad 163 electrically connects to the first contacting pads 161, 162, sequentially in a first order, to generate a first mode change signal. When the earphone plug is rotated in the earphone jack 120 along a second direction as shown in FIG. 3, the second contacting pad 163 electrically connects to the first contacting pads 161, 162, sequentially in a second order, to generate a second mode change signal.

The processor 170 controls the sound output driver 130 to drive the speaker 110 or the earphone 20 so as to provide the audio driving signal from the sound output driver 130 to the speaker 110 or the earphone 20.

In operation, when the earphone plug is not inserted into the earphone jack 120, only the speaker 110 is driven by the sound output driver 130 to output sound since the processor 170 does not receive the initial mode change signal. Under this condition, the audio playing device 10 operates in a speaker playing mode.

When the earphone plug is inserted into the earphone jack 120, the processor 170 receives the initial mode change signal and controls the sound output driver 130 to only drive the earphone 20 so as to output the sound only to the earphone 20. Under this condition, the audio playing device 10 changes from the speaker playing mode into an earphone playing mode. In one embodiment, the processor 170 records a first sound volume Vi of the sound outputted by the speaker 110 when the audio playing device 10 operates in the speaker playing mode without the earphone plug inserted into the earphone jack 120. The processor 170 calculates a second sound volume Vi' to control the sound outputted by the earphone 20 when the audio playing device 10 operates in the earphone playing mode. The second sound volume Vi' may be calculated by a formula of $Vi'=Vi*(Vb/Va)$, where Va represents a maximum sound volume outputted by the speaker 110 and Vb represents a maximum sound volume outputted by the earphone 20.

When the rotation angle detector 160 detects that the earphone plug is rotated in the earphone jack 120 along the first direction by the user over a predetermined angle as shown in FIG. 2, the rotation angle detector 160 generates the first mode change signal and outputs the first mode change signal to the processor 170. The processor 170 controls the sound output driver 130 to only drive the speaker 110. Under this condition, the audio playing device 10 changes from the earphone playing mode into the speaker playing mode. In one embodiment, the processor 170 records a third sound volume Vj of the sound outputted by the earphone 20 when the audio playing device 10 operates in the earphone playing mode. The processor 170 then calculates a fourth sound volume Vj' to control the sound outputted by the speaker 110 when the audio playing device 10 operates in the speaker playing mode with the earphone plug in the earphone jack 120. The fourth sound volume Vj' may be calculated by a formula of $Vj'=Vj*(Va/Vb)$.

When the rotation angle detector 160 detects that the earphone plug is rotated in the earphone jack 120 along the second direction by the user over the predetermined angle as shown in FIG. 3, the rotation angle detector 160 generates the second mode change signal and outputs the second mode change signal to the processor 170. The processor 170 controls the sound output driver 130 to only drive the earphone 20, under this condition, the audio playing device 10 changes its playing mode from the speaker playing mode into the earphone playing mode again. In one embodiment, the processor 170 records a fifth sound volume Vk of the sound outputted by the speaker 110 when the audio playing device 10 operates in the speaker playing mode with the earphone plug in the earphone jack 120, and calculates a sixth sound volume Vk' to control the sound outputted by the earphone 20 when the audio playing device 10 operates in the speaker playing mode again with the earphone plug in the earphone jack 120. The sixth sound volume Vk' may be calculated by a formula of Vk'=Vk*(Vb/Va).

In the embodiment, the first direction is a clockwise direction and the second direction is a counterclockwise direction as shown in FIGS. 2-3. In alternative embodiment, the first direction may be a counterclockwise direction and the second direction may be a clockwise direction. In one embodiment, the predetermined angle is in range of 45 degrees-90 degrees.

It is to be understood, however, that even though numerous characteristics and advantages of certain inventive embodiments have been set out in the foregoing description, together with details of the structures and functions of the embodiments, the disclosure is illustrative only; and that changes may be made in detail, especially in matters of arrangement of parts within the principles of present invention to the full extent indicated by the broad general meaning of the terms in which the appended claims are expressed.

What is claimed is:

1. An audio playing device operating in a first mode or a second mode, the audio playing device comprising:

a speaker;

an earphone jack configured to receive an earphone plug of an earphone;

a sound output driver only driving the speaker when the audio playing device operates in the first mode, and only driving the earphone when the audio playing device operates in the second mode;

a rotation angle detector detecting rotation of the earphone plug received in the earphone jack, and generating a first mode change signal when the earphone plug is rotated in the earphone jack along a first direction over a predetermined angle; and a processor changing operation of the audio playing device between the first mode and the second mode when the processor receives the first mode change signal from the rotation angle detector;

wherein the rotation angle detector further generates a second mode change signal when the earphone plug is rotated in the earphone jack along a second direction over the predetermined angle;

the processor changes the operation of the audio playing device from the first mode to the second mode when the processor receives the first mode change signal, and changes the operation of the audio playing device from the second mode to the first mode when the processor receives the second mode change signal;

the processor records a first sound volume Vi of the sound outputted by the speaker when the audio playing device operates in the first mode without the earphone plug inserted into the earphone jack, and calculates a second sound volume Vi' according to the first sound volume Vi to control the sound outputted by the earphone when the audio playing device operates in the second mode, the second sound volume Vi' is calculated by a formula of Vi'=Vi*(Vb/Va), wherein Va represents a maximum sound volume outputted by the speaker and Vb represents a maximum sound volume outputted by the earphone.

2. The audio playing device of claim 1, wherein the processor records a third sound volume Vj of the sound outputted by the earphone when the audio playing device operates in the second mode, and calculates a fourth sound volume Vj' to control the sound outputted by the speaker when the audio playing device operates in the first mode with the earphone plug in the earphone jack.

3. The audio playing device of claim 2, wherein the fourth sound volume Vj' is calculated by a formula of Vj'=Vj*(Va/Vb), where Va represents a maximum sound volume outputted by the speaker and Vb represents a maximum sound volume outputted by the earphone.

4. The audio playing device of claim 1, wherein the first direction is a clockwise direction and the second direction is a counterclockwise direction.

5. The audio playing device of claim 1, wherein the first direction is a counterclockwise direction and the second direction is a clockwise direction.

6. The audio playing device of claim 1, wherein the predetermined angle is in a range of 45-90 degrees.

7. The audio playing device of claim 1, wherein the rotation angle detector comprises two first contacting pads arranged along the internal surface of the earphone jack and a second contacting pad arranged on the earphone plug corresponding to the first contacting pads.

8. The audio playing device of claim 7, wherein when the earphone plug is rotated in the earphone jack along the first direction, the second contacting pad is electrically connected to the first contacting pads, sequentially in a first order, to generate the first mode change signal.

9. The audio playing device of claim 7, wherein when the earphone plug is rotated in the earphone jack along the second direction, the second contacting pad is electrically connected to the first contacting pads, sequentially in a second order, to generate the second mode change signal.

10. The audio playing device of claim 1, further comprising an earphone detector to detect if the earphone plug is inserted into the earphone jack, and generate an initial mode change signal to the processor when the earphone plug is inserted into the earphone jack.

11. The audio playing device of claim 10, wherein the processor controls the audio playing device to change operation from the first mode into the second mode when the processor receives the initial mode change signal.

12. The audio playing device of claim 1, wherein the first mode is a speaker playing mode and the second mode is an earphone playing mode.

13. An audio playing device operating in a first mode or a second mode, the audio playing device comprising:

a speaker;

an earphone jack configured to receive an earphone plug of an earphone;

a sound output driver only driving the speaker when the audio playing device operates in the first mode, and only driving the earphone when the audio playing device operates in the second mode;

a rotation angle detector detecting rotation of the earphone plug received in the earphone jack, and generating a first mode change signal when the earphone plug is rotated in the earphone jack along a first direction over a predetermined angle; and a processor changing operation of the audio playing device between the first mode and the second mode when the processor receives the first mode change signal from the rotation angle detector;

wherein the processor records a first sound volume Vi of the sound outputted by the speaker when the audio playing device operates in the first mode without the earphone plug inserted into the earphone jack, and calculates a second sound volume Vi' according to the first sound volume Vi to control the sound outputted by the earphone when the audio playing device operates in the second mode, the second sound volume Vi' is calculated by a formula of Vi'=Vi*(Vb/Va), wherein Va represents a maximum sound volume outputted by the speaker and Vb represents a maximum sound volume outputted by the earphone.

14. An audio playing device operating in a first mode or a second mode, the audio playing device comprising:

a speaker;

an earphone jack configured to receive an earphone plug of an earphone;

a sound output driver only driving the speaker when the audio playing device operates in the first mode, and only driving the earphone when the audio playing device operates in the second mode;

a rotation angle detector detecting rotation of the earphone plug received in the earphone jack, and generating a first mode change signal when the earphone plug is rotated in the earphone jack along a first direction over a predetermined angle; and a processor changing operation of the audio playing device between the first mode and the second mode when the processor receives the first mode change signal from the rotation angle detector;

wherein the processor records a first sound volume Vj of the sound outputted by the earphone when the audio playing device operates in the second mode, and calculates a second sound volume Vj' to control the sound outputted by the speaker when the audio playing device operates in the first mode with the earphone plug in the earphone jack, the second sound volume Vj' is calculated by the formula of Vj'=Vj*(Va/Vb), wherein Va represents a maximum sound volume outputted by the speaker and Vb represents a maximum sound volume outputted by the earphone.

* * * * *